United States Patent [19]

Atlani et al.

[11] 4,170,547

[45] Oct. 9, 1979

[54] PROCESS FOR THE SEPARATION OF DIENIC OR AROMATIC HYDROCARBONS FROM HYDROCARBON FRACTIONS CONTAINING THEM WITH THE AID OF SULFONAMIDES

[75] Inventors: Martial Atlani, Paris; Vincent Corso, Versailles; Claude Wakselman, Villebon; Roben Loutaty; Charles Yacono, both of Le Havre, all of France

[73] Assignees: Compagnie Francaise de Raffinage, Paris; Agence Nationale de Valorisation de la Recherche (ANVAR), Neuilly sur Seine, both of France

[21] Appl. No.: 954,618

[22] Filed: Oct. 25, 1978

[51] Int. Cl.[2] ..... C10G 21/20; C10G 21/22

[52] U.S. Cl. ..... 208/326; 585/856

[58] Field of Search ..... 208/326, 330, 325, 255, 208/291; 260/674 SE, 681.5 R

[56] References Cited

U.S. PATENT DOCUMENTS

| | | | |
|---|---|---|---|
| 2,225,910 | 12/1940 | Gurd et al. | 208/330 |
| 2,385,981 | 10/1945 | Friedman | 208/330 |
| 2,433,751 | 12/1947 | Friedman | 260/674 SE |
| 2,936,325 | 5/1960 | Remes et al. | 260/674 SE |

*Primary Examiner*—George Crasanakis

*Attorney, Agent, or Firm*—Scully, Scott, Murphy & Presser

[57] ABSTRACT

Process for the extraction of diene or aromatic hydrocarbons from petroleum hydrocarbon fractions employing sulfonamides as solvents. Also described are new sulfonamides useful as solvents for the extraction process.

6 Claims, 3 Drawing Figures

PROCESS FOR THE SEPARATION OF DIENIC OR AROMATIC HYDROCARBONS FROM HYDROCARBON FRACTIONS CONTAINING THEM WITH THE AID OF SULFONAMIDES

The present invention relates to the separation of dienic and/or aromatic hydrocarbons, from hydrocarbon fractions containing them; it relates more particularly to the use of sulfonamide solvents for this separation, using known techniques of liquid-liquid extraction and extractive distillation. It also relates to new sulfonamides useful in the process according to the invention.

As used in the instant specification, the term sulfonamides embraces compounds having in their molecular structure the group $>N—SO_2—$.

Numerous selective solvents for the recovery of hydrocarbons are described in the technical literature. With regard to the dienic hydrocarbons, one can particularly mention N-methylpyrrolidone, acetonitrile and dimethylformamide. One of the possible applications of these solvents is, for example, the selective extraction of isoprene from a cut of hydrocarbons in which the number of carbon atoms is equal to about 5 (this cut of hydrocarbons is commonly referred to as the "$C_5$ fraction").

Among the known selective solvents for the extraction of aromatic hydrocarbons, one can mention sulfolane, N-methylpyrrolidone in aqueous solution, derivatives of morpholine such as N-formylmorpholine or dimethylsulfoxide. It is also known to use certain sulfonamides for the extraction of aromatic hydrocarbons. Thus, U.S. Pat. No. 2,225,910 describes the use of alkyl aryl sulfonamides, of the general formula

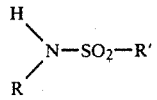

wherein R is an alkyl group and R′ is an aryl group. The article of MAKITRA R. G., YAS'KOVYAK A. and GUMENETSKII V. V., "Extraction of Aromatic Hydrocarbons with Dialkylamides of Alkane-Sulfonic Acids", appearing in Neftepererabotka i Neftekhimiya, 1976 (1) pages 45–46, describes the use of N,N,diethylmethanesulfonamide and N,N,dimethylethanesulfonamide as solvent for the extraction of aromatic hydrocarbons from hydrocarbon cuts containing same.

Applicants have now discovered that in general sulfonamide solvents including the sulfonamides disclosed in the article by Makitra can be used for separation by extraction, using known methods, of diene hydrocarbons from hydrocarbon fractions containing same. In addition, applicants have discovered that a substantial number of sulfonamide solvents, in addition to those disclosed in the aforesaid Makitra article, can be used in the extraction of aromatic hydrocarbons from petroleum cuts containing same. The sulfonamides employed in the present invention include certain sulfonamides heretofore unknown.

Another object of the present invention is consequently to provide new solvents for the separation of hydrocarbons from petroleum hydrocarbon fractions.

Another object of the invention is to prepare new sulfonamides useful in a process for separating hydrocarbons from petroleum hydrocarbon fractions.

A first object of the present invention is therefore embodied in a process for the extraction of dienic hydrocarbons from hydrocarbon fractions containing them, by known techniques of liquid-liquid extraction and/or extractive distillation, said process being characterized in that the solvent employed comprises at least one sulfonamide, the said sulfonamide being selected from the group consisting of:

(a) compounds A of the general formula

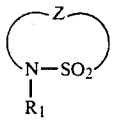

wherein $R_1$ is a hydrogen atom or a linear or branched alkyl group containing from 1 to 4 carbon atoms and Z is a chain of from 2 to 4 carbon atoms which can contain a heteroatom such as oxygen, for example:

(b) compounds B of the general formula

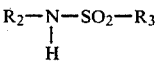

wherein $R_2$ and $R_3$ are alkyl groups having from 1 to 4 carbon atoms;

(c) compounds C of the general formula

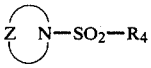

wherein $R_4$ is a linear or branched alkyl group having from 1 to 4 carbon atoms and Z is a chain of from 2 to 5 carbon atoms which may contain a heteroatom such as oxygen, for example:

(d) compounds D of the general formula

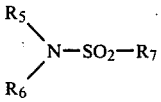

wherein $R_5$, $R_6$ and $R_7$ are alkyl groups having from 1 to 4 carbon atoms.

A second object of the present invention is comprised by a process for the extraction of aromatic hydrocarbons from hydrocarbon fractions containing them, by known techniques of liquid-liquid extraction and/or extractive distillation, said process being characterized in that there is employed as solvent at least one sulfonamide, said sulfonamide being selected from the group consisting of compounds A, B and C hereinabove and N,N-diethylethanesulfonamide and N,N-dimethylmethanesulfonamide.

Compounds A can be prepared by the method described by W. F. ERMAN and H. C. KRETSCHMAR in an article appearing in "The Journal of Organic Chemistry", Dec. 1961, Volume 26, Pages 4841 and following, wherein is described notably the preparation of N methylpropanesultam, of the formula:

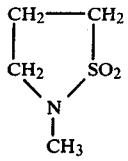

and N butylpropanesultam, of the formula:

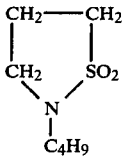

Applicants have, by this method, prepared N ethylpropanesultam, of the formula:

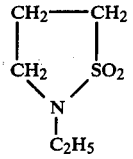

which is a new sulfonamide.

Compounds B, C and D can be prepared by the method described by R. M. MORIARTY in an article appearing in "The Journal of Organic Chemistry" 1965, Volume 30, Pages 600 and following.

This method consists in reacting the chloride of a sulfonic acid with an amine, following the reaction (in the case of a primary amine):

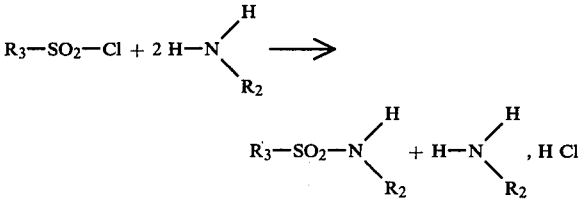

Applicants have also prepared the following known sulfonamides:

N-methylmethanesulfonamide:

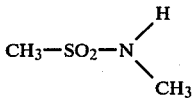

N-methylethanesulfonamide:

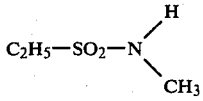

N-ethylmethanesulfonamide:

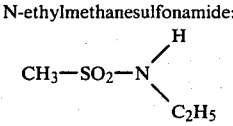

N-ethylethanesulfonamide:

-continued

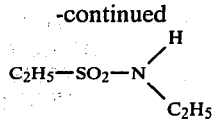

N-propylmethanesulfonamide:

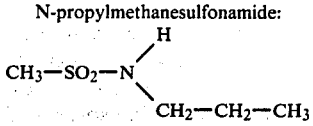

N-isopropylmethanesulfonamide:

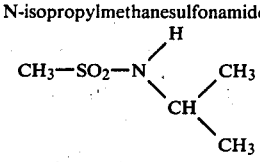

N-ethanesulfonylpyrrolidine:

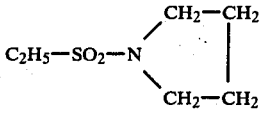

N,N-diethylmethanesulfonamide:

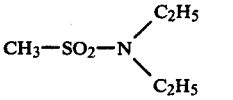

N,N-dimethylmethanesulfonamide:

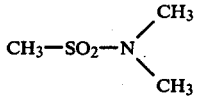

N,N-dimethylethanesulfonamide:

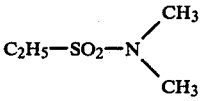

By this method, applicants have succeeded in preparing the following new sulfonamides N,N-diethylethanesulfonamide:

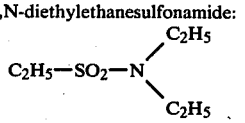

N-ethanesulfonylpiperidine:

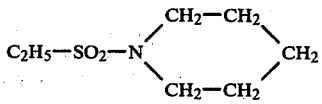

N-ethanesulfonylmorpholine:

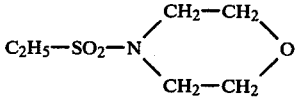

Applicants have established the effectiveness of sulfonamides in a process for the extraction of dienic and/or aromatic hydrocarbons from fractions containing them. This effectiveness can be shown by several tests. One can measure, for example, the relative volatility of an extracted compound by comparison with a reference compound (or vice-versa). One can also carry out extraction by a classical method and analyze the extract, on the one hand, the raffinate, on the other. Such tests are illustrated in the examples.

Regardless of the extraction technique employed, the quantities of solvent used are, in general, between about 0.5 and 5 times the volume of the hydrocarbon charge to be treated, but this quantity can be greater, if one desires to obtain a high purity of dienic or aromatic hydrocarbons.

The solvent employed can be more or less pure; "commercial" purity will most often be employed in the extraction. The sulfonamides can be used as such, in mixture with themselves or with other sulfonamides or even in mixture with one or several other solvents.

The extraction can be carried out by liquid-liquid extraction or by extractive distillation.

The two techniques can moreover be combined, the charge being enriched, in a first stage, for the chemical species to be extracted, by liquid-liquid extraction, then, in a second stage, subjected to an extractive distillation, which provides for the recovery of the chemical species desired.

Three figures of non-limitative drawings are annexed to the present description.

On these figures, the recycles from the head and from the base of the columns have not been shown, for the sake of clarity.

Figure 1:
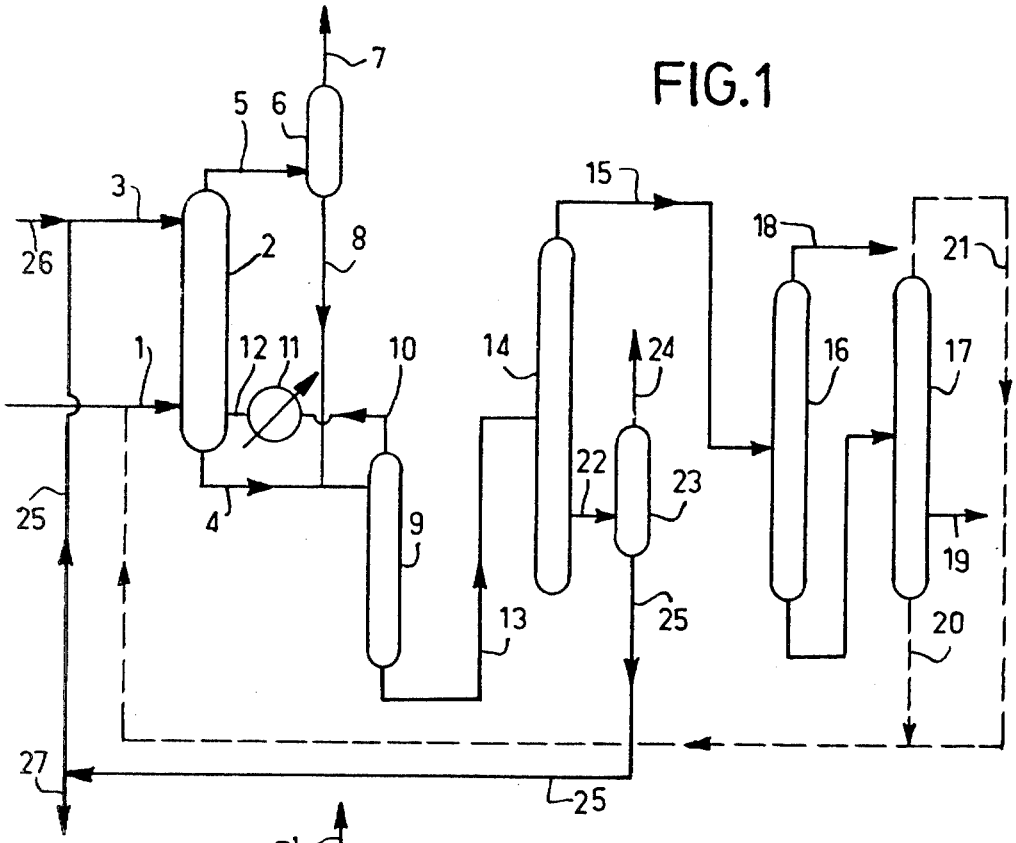
FIGS. 1 and 2 are schematic diagrams illustrating the application of the process according to the invention for the continuous extraction of isoprene from a charge of hydrocarbons containing 5 carbon atoms.

One is first referred to FIG. 1.

Referring to FIG. 1, a charge, obtained from the distillation of cracking oil and having been eventually subjected to a preliminary thermal treatment intended to dimerize the cyclopentadiene, is introduced through line 1, in the liquid state, into the lower section of a liquid-liquid extraction column 2. The solvent, containing at least one sulfonamide, is introduced through line 3, in the liquid state, into the upper section of column 2.

The solvent containing the diolefins and a small quantity of pentenes is recovered through line 4, at the base of column 2.

Through line 5, at the top of column 2, is recovered the raffinate comprised principally of the pentanes, the pentenes and light traces of dienes. This raffinate is conveyed through line 5 into a distillation chamber 6, wherein traces of solvent contained therein are removed. The raffinate is evacuated from chamber 6 through line 7 while the solvent is conveyed to line 4 through line 8.

The solvent containing the diolefins and a small quantity of pentenes circulating in line 4 is conveyed into the upper section of rectification column 9.

The vapors recovered at the head of column 9 through line 10 are liquified in condenser 11; the resulting liquid is introduced through line 12 into the lower section of column 2. The solvent, charged with diolefins, olefins and acetylenic hydrocarbons, is introduced through line 13 into the intermediate section of extractive distillation column 14. At the head of column 14, one recovers, through line 15, a mixture of isoprene and cyclopentene, which one separates by distillation in columns 16 and 17, the isoprene being recovered through line 18 at the head of column 16, and the cyclopentene, by a side discharge from column 17, through line 19. The bottoms, recovered through line 20, and/or the head vapors, recovered in line 21 of column 17, can be recycled in the charge to column 2.

Through line 22, there is laterally discharged from column 14 a gaseous stream principally comprising the pentadienes, cyclopentadiene and the acetylenic hydrocarbons. The solvent vapors are separated from the hydrocarbons by distillation in chamber 23.

The hydrocarbons are recovered at the top of chamber 23 through line 24. Solvent recovered at the base of chamber 23 through line 25 is recycled to column 2 through line 3. Fresh solvent can be introduced into line 25 through line 26 and spent solvent can be discharged through purge 27.

Figure 2:
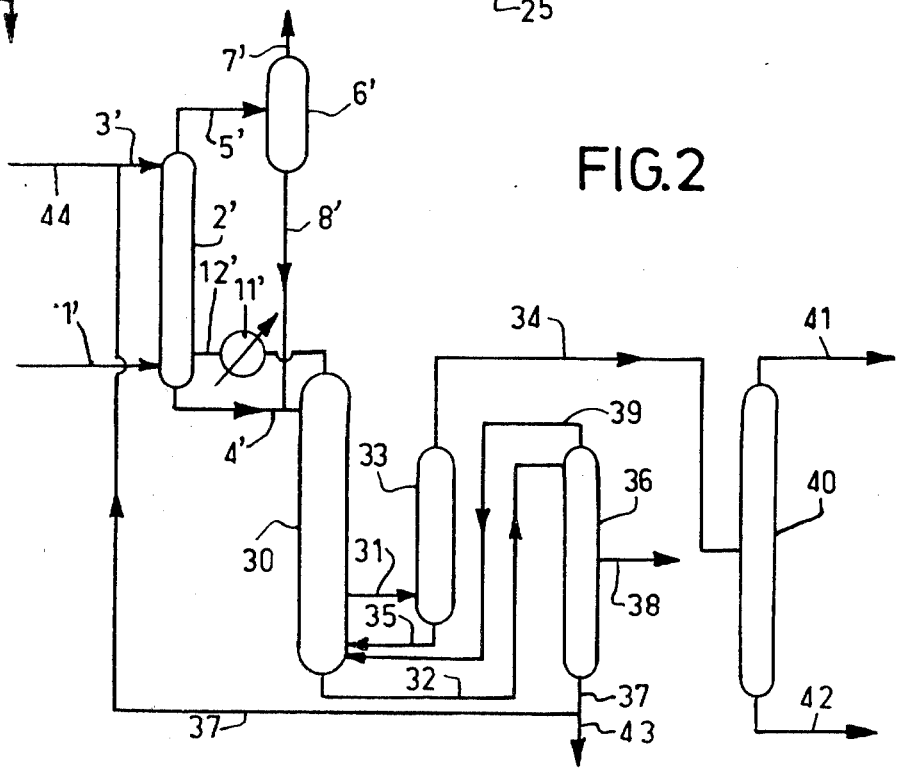

In another embodiment of the invention schematically represented in FIG. 2, for which the elements identical to those of FIG. 1 have been identified by the same reference numerals bearing a prime mark, extraction column 2′ is identical to column 2 of FIG. 1, but rectification column 30 is more effective than column 9, the latter permitting the side withdrawal, through line 31, of a mixture of vapors of isoprene and cyclopentene charged with solvent and, at the base, through line 32, the major part of liquid solvent charged with less volatile hydrocarbons in the presence of solvent, that is, cyclopentadiene, the pentadienes and the acetylenic hydrocarbons. The vapors of solvent are separated from isoprene and cyclopentene by distillation in chamber 33.

Isoprene and cyclopentene are recovered through line 34, the solvent being returned to column 30 through line 35.

The bottoms from column 30 are returned through line 32 into apparatus for the recovery of solvent constituting column 36; the solvent recovered through line 37, at the base of column 36, being recycled in column 2′ through line 3′; column 36 comprising a side withdrawal point 38, through which there is withdrawn a mixture of cyclopentadiene, pentadienes and acetylenic hydrocarbons. At the head of column 36 is recovered a vapor phase, through line 39, which is recycled in the lower section of column 30.

Line 34 feeds a fractionation column 40, from which one recovers isoprene, at the head, through line 41, and cyclopentene, at the base, through line 42. Fresh solvent can be introduced into line 37 through line 44 and spent solvent can be withdrawn through purge 43.

Figure 3:
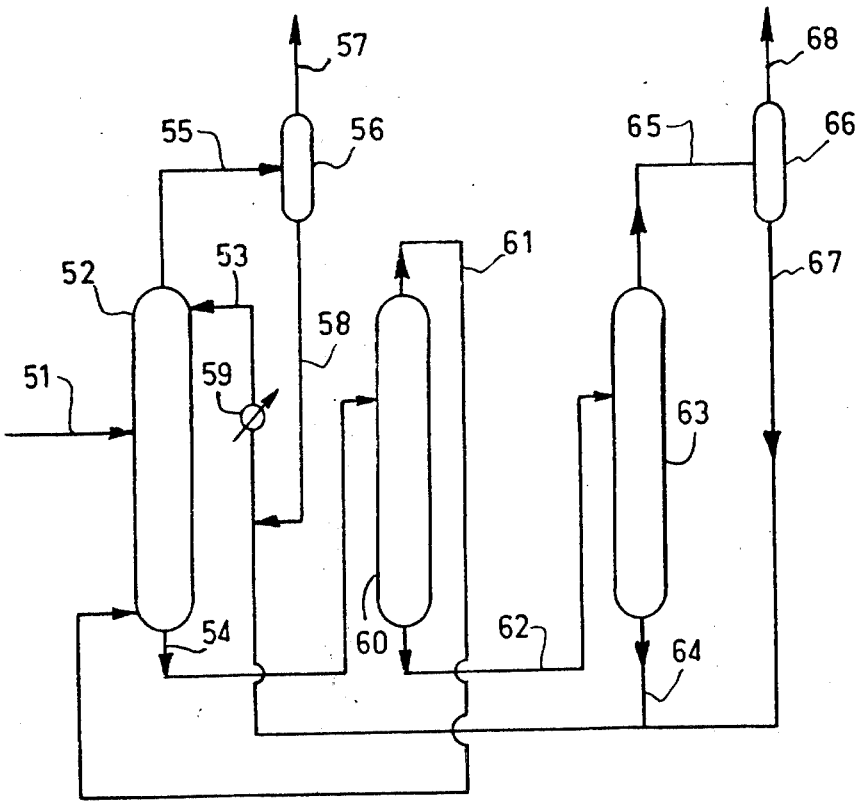
FIG. 3 is a schematic diagram illustrating the application of the process of the invention for the continuous extraction of aromatic hydrocarbons from a charge containing them.

Referring to FIG. 3, a charge, for which one desires to separate the aromatic hydrocarbons, obtained by reforming a petroleum fraction, is introduced through line 51 into the intermediate section of extraction column 52. The solvent, containing at least one sulfonamide, is introduced through line 53 in the liquid state into the upper section of column 52. One recovers through line 54, at the base of column 52, the solvent containing the aromatic hydrocarbons and a certain quantity of non-aromatic hydrocarbons.

The raffinate comprising non-aromatic hydrocarbons is recovered through line 55 at the head of column 52. This raffinate is introduced through line 55 into distillation chamber 56 where it is separated from traces of solvent contained therein. The raffinate is withdrawn from chamber 56 through line 57. The solvent recovered from line 58 is recycled to column 52 through line 53 after passage through condenser 59. The solvent containing the aromatic hydrocarbons and a certain quantity of non-aromatic hydrocarbons recovered from line 54 is conveyed to the intermediate section of extracted distillation column 60. At the head of column 60, is recovered, through line 61, the non-aromatic hydrocarbons and a small quantity of aromatic hydrocarbons which are recycled to the base of column 52. The solvent containing the aromatic hydrocarbons is recovered through line 62 at the base of column 60.

The solvent containing the aromatic hydrocarbons is conveyed into the middle section of column 63 operated under reduced pressure. The solvent is recovered at the base of column 63, through line 64, and is recycled to column 52.

At the top of column 63, through line 65, are recovered the aromatic hydrocarbons containing traces of solvent, which are separated in distillation chamber 66. At the base of chamber 66, through line 67, is recovered the solvent, which is recycled to column 52. The aromatic hydrocarbons are recovered at the top of chamber 66 through line 68.

The invention is illustrated by the examples which follow and which are of non-limitative character.

Example 1 is intended to illustrate the preparation of a new sulfonamide by the method of ERMAN and KRETSCHMAR.

Example 2 is intended to illustrate the preparation of new sulfonamides by the method of MORIARTY.

Examples 3 to 8 illustrate the use of sulfonamides in a process for the extraction of hydrocarbons according to the invention.

EXAMPLE 1

This example illustrates the preparation of N-ethylpropanesultam by the method described by ERMAN and KRETSCHMAR in the aforecited article.

To a solution of 24 g of chloride of 3-chloropropanesulfonic acid in 150 ml ethyl ether is added drop-by-drop a solution of 12 g ethylamine and 10 ml ethyl ether. The addition of the ethylamine solution is carried out under stirring and with cooling with the aid of an ice bath. After addition of the solution, the stirring is continued for 1 hour. A white precipitate of ethylamine chlorhydrate forms, which is removed by filtration upon fritted glass. Ethyl ether is removed by evaporation under reduced pressure and, to the residue obtained, is added a mixture of 4.8 g soda pellets, 400 ml ethanol and 12.5 g triethylamine. The mixture is subjected to reflux for 2 hours. After cooling, the solvent is evaporated and the residue is distilled under vacuum. There is obtained 14.2 g (yield: 70%) of N-ethylpropanesultam (boiling point under 0.1 torr: 88° C.).

EXAMPLE 2

This example concerns the preparation of new sulfonamides by the method described by MORIARTY in the aforecited article.

In a two-liter flask equipped with a stirrer and cooling apparatus, is introduced 0.42 mole of the sulfonyl chloride in solution in 500 ml anhydrous ether. 0.84 mole of an amine in solution in 300 ml anhydrous ether is added drop-by-drop. The contents of the flask are agitated while maintaining a temperature less than 0° C. during the addition of the amine and immersing the flask in a bath containing a mixture of ice and sodium chloride.

The reaction medium is allowed to come to ambient temperature while stirring. The solution obtained is filtered to remove the amine hydrochloride formed. The solvent is evaporated and the product obtained is distilled. The products obtained were analyzed by gas-liquid chromatography and nuclear magnetic resonance.

The sulfonamides obtained, as well as their boiling points or melting points and their purity, and the starting products are given in Table I hereinbelow.

TABLE I

| STARTING PRODUCTS | | SULFONAMIDE | | |
|---|---|---|---|---|
| chloride of sulfonic acid | amine | sulfonamide prepared | purity in % | boiling point |
| ethane sulfonyl chloride | diethylamine | N,N-diethylethane sulfonamide | 98.6 | tE : 85° C. under 1.4 torr |
| ethane sulfonyl chloride | piperidine | N-ethane sulfonyl piperidine | 98.9 | tE : 98° C. under 0.1 torr |
| ethane sulfonyl chloride | morpholine | N-ethane sulfonyl morpholine | | tF : 50° C. under 760 torr |

EXAMPLE 3

This example relates to the determination of the relative volatility, by comparison to isoprene, and in different solvents according to the invention, compositions from a fraction of hydrocarbons having five carbon atoms. This determination is carried out by chromatography, in a known fashion, by measuring the retention time. The relative volatility $\alpha_i$ of a hydrocarbon i having five carbon atoms by comparison to isoprene is expressed by the equation:

$$\alpha_i, \text{isoprene} = \frac{\text{time of retention of isoprene}}{\text{time of retention of composition i}}$$

The chromatographic column utilized is 3 meters long and possesses a diameter equal to ⅛ inch which is to say 3.17 mm. It is made of stainless steel, and the stationary phase is the product known under the commercial name CHROMOSORB P 60/80 Mesh, impregnated with 25% by weight of the solvent being tested. The column is maintained at 30° C. The carrier gas is helium, flowing at a rate of 25 $cm^3$/mn. The components of the fraction are detected in a catharometer situated downstream of the column.

Two temperatures are employed:

(a) a mixture of constituents, having the composition shown in Table II below, is first injected.

TABLE II

| Hydrocarbon | % by weight |
|---|---|
| n-pentane | 12.59 |
| pentene-1 | 7.15 |
| methyl-2-butene-1 | 11.73 |
| pentene-2 (cis and trans) | 8.01 |
| methyl-2 butene-2 | 7.44 |
| isoprene | 30.62 |
| pentadiene-1,3 (cis and trans) | 22.46 |

(b) Then there is injected the remaining $C_5$ hydrocarbons mentioned in Table III.

The injections are, importantly, carried out under rigorously identical conditions.

Reported in Table III are the results obtained for the relative volatilities of 13 hydrocarbons having 5 carbon atoms, by comparison to isoprene (also indicated is the boiling point of each of these hydrocarbons and its relative volatility obtained in the absence of solvent, by comparison to isoprene at 30° C.).

TABLE III

| Hydrocarbon | boiling point in °C., under 760 torr | without solvent | N,N-diethyl-methane-sulfonamide | N,N-dimethyl-ethane-sulfonamide | N,N-diethyl-ethane-sulfonamide | N-ethane sulfonyl-piperidine | N-ethane sulfonyl-pyrrolidine |
|---|---|---|---|---|---|---|---|
| isopentane | 27.87 | 1.053 | 4.40 | 5.24 | 3.08 | 4.37 | 5.26 |
| pentene-1 | 29.97 | 1.039 | 2.42 | 2.58 | 1.72 | 2.33 | 2.54 |
| methyl-2-butene-1 | 31.16 | 1.025 | 2.11 | 2.23 | 1.52 | 2.06 | 2.21 |
| isoprene | 34.06 | 1.000 | 1.00 | 1.00 | 1.00 | 1.00 | 1.00 |
| n-pentane | 36.07 | 0.998 | 3.79 | 4.12 | 2.34 | 3.24 | 3.65 |
| pentene-2 trans | 36.35 | 0.998 | 1.80 | 2.14 | 1.45 | 1.88 | 2.14 |
| pentene-2 cis | 36.94 | 0.989 | 1.85 | 1.97 | 1.33 | 1.75 | 1.95 |
| methyl-2-butene-2 | 38.57 | 0.972 | 1.60 | 1.75 | 1.19 | 1.57 | 1.75 |
| cyclopentadiene | 40.00 | 0.957 | 0.57 | 0.51 | 0.61 | 0.59 | 0.53 |
| pentadiene 1-3 trans | 42.03 | 0.970 | 0.75 | 0.75 | 0.58 | 0.74 | 0.75 |
| pentadiene 1-3 cis | 44.07 | 0.954 | 0.67 | 0.67 | 0.53 | 0.67 | 0.67 |
| cyclopentene | 44.24 | 0.915 | 0.98 | 0.95 | 0.95 | 0.90 | 0.90 |
| cyclopentane | 49.26 | 0.886 | 1.35 | 1.41 | 1.24 | 1.18 | 1.33 |

This table shows the results achieved with the solvents according to the invention by comparing the relative volatilities obtained in the presence of solvent to those obtained in the absence of solvent.

EXAMPLE 4

This example illustrates the determination of the relative volatility, by comparison to benzene and in different solvents according to the invention, of two hydrocarbons of which the boiling point is close to that of benzene; therefore, for the separation of these products and benzene, an extractive distillation or a liquid-liquid extraction is desirable. The determination is conducted in a manner identical to that of Example 3: only the temperature of the column is varied, it is raised to 50° C.

These relative volatilities obtained with the solvents according to the invention are reported in Table IV. It also mentions the values of relative volatilities measured without solvent under the same conditions.

TABLE IV

| Hydrocarbon | boiling point in °C., under 760 torr | without solvent | N,N-diethyl-ethane-sulfonamide | N-ethane sulfonyl-piperidine | N-ethane sulfonyl-pyrrolidine |
|---|---|---|---|---|---|
| Benzene | 80.10 | 1.00 | 1.00 | 1.00 | 1.00 |
| Dimethyl 2-4 pentane | 80.50 | 1.02 | 6.55 | 8.35 | 12.24 |
| Cyclohexane | 80.74 | 0.96 | 3.94 | 4.62 | 6.12 |

The conclusion upon a reading of this table is identical to that of Example 3.

EXAMPLE 5

This example concerns the application of different solvents according to the invention for the extraction of an aromatic hydrocarbon. A mixture is prepared in a separatory funnel containing by weight 50% solvent, 17.5% benzene and 32.5% n-heptane. After stirring, the mixture is allowed to reach a temperature of 20° C., obtaining two phases, the characteristics of which are set forth hereinafter in Table V. In this table:

K, coefficient of distribution, represents the weight ratio of fractions of substances contained in the extract and in the raffinate, S, selectivity, is the quotient of the coefficient of distribution of extracted substances (namely, benzene), to that of diluent (namely, n-heptane).

The increased selectivities obtained show that the separations are effective. Thus benzene can be extracted from its mixtures with n-heptane by using the solvent in the table.

TABLE V

| Mixture | extract % by weight | raffinate % by weight | K | S |
|---|---|---|---|---|
| Benzene | 9.54 | 27.55 | 0.346 | 36.35 |
| N-heptane | 0.68 | 71.39 | 0.00952 | |
| Methyl-methane sulfonamide | 89.78 | 1.06 | | |
| Benzene | 10.65 | 26.55 | 0.401 | 22.88 |
| N-heptane | 1.26 | 71.86 | 0.0175 | |
| Ethyl-methane sulfonamide | 88.09 | 1.59 | | |
| Benzene | 9.90 | 28.05 | 0.353 | 19.17 |
| N-heptane | 1.30 | 70.62 | 0.0184 | |
| Methyl-ethane sulfonamide | 88.80 | 1.33 | | |
| Benzene | 16.1 | 20.0 | 0.805 | 8.30 |
| N-heptane | 6.8 | 70.1 | 0.097 | |
| N-ethane-sulfonyl pyrrolidone | 77.1 | 9.9 | | |
| Benzene | 15.1 | 21.6 | 0.699 | 13.69 |
| N-heptane | 3.9 | 76.4 | 0.051 | |
| Ethyl-propane sultam | 81.0 | 2.0 | | |

EXAMPLE 6

This example illustrates the determination of volatility relative to infinite dilution, by comparison to benzene and in different solvents according to the invention, of two hydrocarbons of which the boiling point is near that of benzene; consequently, for the separation of these products and benzene, an extractive distillation or a liquid-liquid extraction are desirable. The determination has been carried out at 50° C. by the exponential dilution method (see "Accurate Measurement of Activity Coefficients at Infinite Dilution by Inert Gas Stripping and Gas Chromatography"), Ind. Eng. Chem. Process Des. Dev. Volume 16, No. 1, 1977, pages 139 and 144, J. C. LEROI, J. C. MASSON, H. RENON, J. F. FABRIES and H. SANNIER.

These relative volatilities obtained with the solvents according to the invention are reported in Table VI herebelow. It also mentions the values of relative volatilities measured without solvent under the same conditions. Table VI shows the advantage obtained through solvents according to the invention by comparing the relative volatilities obtained in the presence of solvent to those obtained in the absence of solvent.

TABLE VI

| Hydrocarbon | boiling point (°C.) under 360 torr | Relative volatilities compared to benzene: without solvent | Methyl methane sulfonamide | Ethyl methane sulfonamide | Methyl ethane sulfonamide | Propyl methane sulfonamide | Ethyl ethane sulfonamide | Ethyl propane sultam |
|---|---|---|---|---|---|---|---|---|
| Benzene | 80.10 | 1 | 1 | 1 | 1 | 1 | 1 | 1 |
| Dimethyl 2-4 pentane | 80.50 | 1.02 | 23.20 | 18.00 | 19.95 | 10.60 | 12.92 | 16.98 |
| Cyclohexane | 80.74 | 0.96 | 10.26 | 7.68 | 8.20 | 5.29 | 5.95 | 7.51 |

EXAMPLE 7

This example concerns the application of different solvents according to the invention for the extraction of a dienic hydrocarbon. Using the procedure of Example 5, a mixture is prepared containing by weight 50% solvent, 10% isoprene and 40% n-pentane. The results set forth in Table VII demonstrate the effectiveness of the extractions thus carried out:

TABLE VII

| Mixture | extract % by weight | raffinate % by weight | K | S |
|---|---|---|---|---|
| Isoprene | 2.20 | 17.53 | 0.125 | 3.39 |
| N-pentane | 2.83 | 76.44 | 0.0370 | |
| Ethyl-methane sulfonamide | 94.97 | 6.03 | | |

EXAMPLE 8

This example illustrates the determination of the volatility relative to infinite dilution, by comparison to isoprene and in different solvents according to the invention of 2-methylbutene-2 having a boiling point about that of isoprene. The determination was carried out at 30° C. by the exponential dilution method to which reference was made in Example 6. The results set forth in Table VIII show the advantage achieved through the use of solvents according to the present invention.

TABLE VIII

| Hydrocarbon | boiling point under 760 mm Hg | without solvent | Propyl-methane sulfonamide | Ethyl-ethane sulfonamide |
|---|---|---|---|---|
| Isoprene | 34.06 | 1.000 | 1.000 | 1.000 |
| Mehtyl-2 butene-2 | 38.57 | 0.972 | 1.490 | 1.754 |

What is claimed is:

1. A process for the separation of dienic hydrocarbons from hydrocarbon fractions containing same, which comprises the step of extracting said fractions with at least one sulfonamide solvent, said sulfonamide being selected from the group consisting of:

(a) compounds A of the general formula:

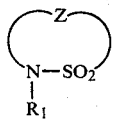

wherein $R_1$ is a hydrogen atom or alkyl containing 1 to 4 carbon atoms and Z is a chain of 2 to 4 carbon atoms which can contain a heteroatom;

(b) compounds B of the general formula

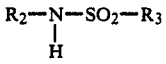

wherein $R_2$ and $R_3$ are alkyl groups containing 1 to 4 carbon atoms;

(c) compounds C of the general formula

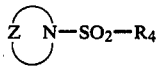

wherein $R_4$ is an alkyl group containing 1 to 4 carbon atoms and Z is a chain of from 2 to 5 carbon atoms which can contain a heteroatom; and (d) compounds D of the general formula

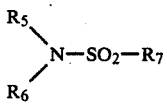

wherein $R_5$, $R_6$ and $R_7$ are alkyl groups containing 1 to 4 carbon atoms.

2. Process according to claim 1, characterized in that the sulfonamide is selected from the group consisting of:
N,N-diethylmethanesulfonamide,
N,N-dimethylethanesulfonamide,
N,N-diethylethanesulfonamide,
N-ethanesulfonylpiperidine,
N-ethanesulfonylpyrrolidine,
N-ethylpropanesultam,
N-methylmethanesulfonamide,
N-ethylmethanesulfonamide,
N-propylmethanesulfonamide,
N-ethylethanesulfonamide, and
N-methylethanesulfonamide.

3. Sulfonamides to be employed in the process according to one of claims 1 or 2, said sulfonamide being selected from the group consisting of:
N-ethylpropanesultam,
N,N-diethylethanesulfonamide,
N-ethanesulfonylpiperidine, and
N-ethanesulfonylmorpholine.

4. A process for the separation of aromatic hydrocarbons from hydrocarbon fractions containing same, which comprises the step of extracting said fractions with at least one sulfonamide solvent, said sulfonamide being selected from the group consisting of:

(a) compounds A of the general formula

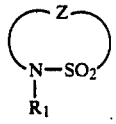

wherein $R_1$ is a hydrogen atom or alkyl containing 1 to 4 carbon atoms and Z is a chain of 2 to 4 carbon atoms which can contain a heteroatom;

(b) compounds B of the general formula

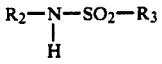

wherein $R_2$ and $R_3$ are alkyl groups containing 1 to 4 carbon atoms;

(c) compounds C of the general formula

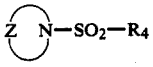

wherein $R_4$ is an alkyl group containing 1 to 4 carbon atoms and Z is a chain of from 2 to 5 carbon atoms which can contain a heteroatom; and (d) N-N-diethylethanesulfonamide and N-N-dimethylmethanesulfonamide.

5. Process according to claim 4, characterized in that the sulfonamide is selected from the group consisting of:

N,N-diethylethanesulfonamide,
N-ethanesulfonylpiperidine,
N-ethanesulfonylpyrrolidine,
N-ethylpropanesultam,
N-methylmethanesulfonamide,
N-ethylmethanesulfonamide,
N-propylmethanesulfonamide,
N-ethylethanesulfonamide, and
N-methylethanesulfonamide.

6. Sulfonamides to be employed in the process according to one of claims 4 or 5, said sulfonamide being selected from the group consisting of:

N-ethylpropanesultam,
N,N-diethylethanesulfonamide,
N-ethanesulfonylpiperidine, and
N-ethanesulfonylmorpholine.

* * * * *